US010161400B2

(12) United States Patent
Milliff et al.

(10) Patent No.: US 10,161,400 B2
(45) Date of Patent: Dec. 25, 2018

(54) SNAP-IN TEMPERATURE SENSOR FOR SCROLL COMPRESSOR

(71) Applicant: Danfoss Scroll Technologies, LLC, Arkadelphia, AR (US)

(72) Inventors: Tracy Milliff, Arkadelphia, AR (US); Gregory W Hahn, Mt. Washington, KY (US); William Cargile, Arkadelphia, AR (US); Stephen Avary, Amity, AR (US)

(73) Assignee: DANFOSS SCROLL TECHNOLOGIES, LLC, Arkadelphia, AR (US)

( * ) Notice: Subject to any disclaimer, the term of this patent is extended or adjusted under 35 U.S.C. 154(b) by 874 days.

(21) Appl. No.: 14/336,335

(22) Filed: Jul. 21, 2014

(65) Prior Publication Data

US 2016/0017886 A1 Jan. 21, 2016

(51) Int. Cl.

| | |
|---|---|
| ***F04C 28/28*** | (2006.01) |
| ***F04C 18/02*** | (2006.01) |
| ***F04C 23/00*** | (2006.01) |

(52) U.S. Cl.

CPC ..... *F04C 28/28* (2013.01); *F04C 18/0215* (2013.01); *F04C 23/008* (2013.01); *F04C 2240/81* (2013.01); *F04C 2270/19* (2013.01)

(58) Field of Classification Search

CPC ..... F04C 2240/81; F04C 2270/19; Y10T 403/1616; Y10T 403/1624; Y10T 403/17; Y10T 403/20

USPC ..... 73/866.5; 374/141, 208, 147, 152, 183

See application file for complete search history.

(56) References Cited

U.S. PATENT DOCUMENTS

| | | | | |
|---|---|---|---|---|
| 3,877,837 | A | 4/1975 | Parker et al. | |
| 5,368,446 | A | 11/1994 | Rode | |
| 6,171,064 | B1 * | 1/2001 | Hugenroth | F04C 28/28 417/32 |
| 6,398,507 | B1 | 6/2002 | Choi | |
| 6,406,265 | B1 | 6/2002 | Hahn et al. | |
| 7,194,871 | B2 | 3/2007 | DeBernardi et al. | |
| 2004/0102099 | A1 * | 5/2004 | Han | H01R 13/6467 439/676 |
| 2004/0182132 | A1 * | 9/2004 | Head | G01L 19/0007 73/23.2 |
| 2005/0100449 | A1 | 5/2005 | Hahn et al. | |
| 2007/0177983 | A1 * | 8/2007 | Levan | F04B 49/022 417/19 |
| 2008/0092673 | A1 * | 4/2008 | Hansel | B60S 1/0822 73/866.5 |
| 2010/0028184 | A1 * | 2/2010 | Hahn | F04B 39/121 418/55.4 |
| 2012/0052708 | A1 * | 3/2012 | Herring | H01R 4/182 439/345 |

FOREIGN PATENT DOCUMENTS

JP 2005308360 A 11/2005

* cited by examiner

*Primary Examiner* — Kenneth J Hansen

(74) *Attorney, Agent, or Firm* — Carlson, Gaskey & Olds, P.C.

(57) ABSTRACT

A temperature sensor on an outer surface of an upper shell at a location is associated with a discharge chamber. The temperature sensor includes electronics molded into an overmolded plastic and includes a spring member. The spring member snaps into a sensor housing connected to the outer surface.

13 Claims, 3 Drawing Sheets

SNAP-IN TEMPERATURE SENSOR FOR SCROLL COMPRESSOR

BACKGROUND OF THE INVENTION

This application relates to a temperature sensor, which may be associated with an upper shell of a scroll compressor housing and which snaps into a protected sensor housing.

Scroll compressors are known and, typically, include a first scroll member having a spiral wrap extending from a base. A second scroll member also has a spiral wrap extending from its base. The two spiral wraps interfit to define compression chambers. One of the two scroll members is caused to orbit relative to the other. As this movement occurs, the size of the compression chamber is decreased and refrigerant is compressed.

There are many challenges with operating scroll compressors. Several conditions can cause the temperatures within the scroll compressor to reach unduly high levels. Thus, it is known to have a shutoff switch associated with a motor for the scroll compressor.

Scroll compressor motors often have a shutoff switch incorporated within a housing shell that houses the motor and the two scroll members. This is not always as sensitive as would be desired. Thus, it has also been proposed to incorporate temperature sensors on the housing shell. However, providing a mount for a temperature sensor that will protect the temperature sensor and is also a location that provides good feedback of the internal temperature has been challenging.

SUMMARY OF THE INVENTION

A scroll compressor has a housing shell including a cylindrical lower portion and an upper cover portion. The upper cover portion has an outer surface. A scroll compressor pump unit includes a first scroll member having a base and a generally spiral wrap extending from its base. A second scroll member having a base and a generally spiral wrap extending from its base. The wraps of the first and second scroll members interfit to define compression chambers. The first scroll member has a discharge port. An electric motor drives a drive shaft to rotate and, in turn, causes the second scroll member to orbit relative to the first scroll member and to decrease volume of the compression chambers such that a refrigerant is compressed. The refrigerant is driven towards the center of the first and second scroll member wrap to communicate with the discharge port. A discharge pressure plenum is defined inwardly of the upper shell and communicates with the discharge port. A temperature sensor connects to the outer surface of the upper shell at a location associated with the discharge plenum. The temperature sensor includes a temperature sensor member that includes electronics molded into an overmolded plastic and includes a spring member. The spring member snaps into a housing member welded to the outer surface.

These and other features may be best understood from the following drawings and specification.

DETAILED DESCRIPTION

Figure 1:
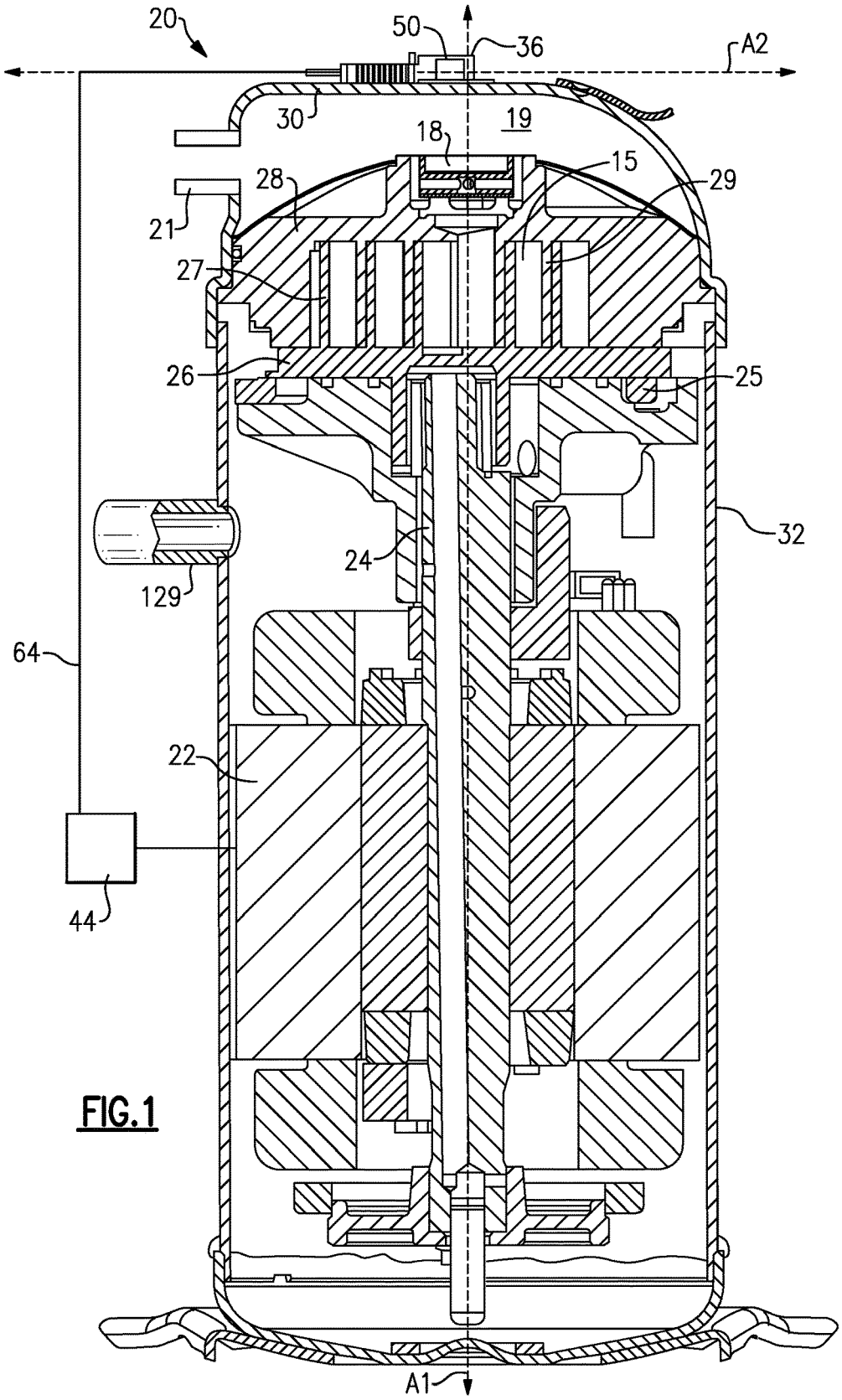
FIG. 1 schematically shows a scroll compressor.

FIG. 1 shows a scroll compressor 20 including a lower housing cylindrical portion 32 and an upper shell 30 closing off the housing. A non-orbiting scroll member 28 has a spiral wrap 29 extending from a base. An orbiting scroll member 26 has a spiral wrap 27 extending from its base. The wraps interfit to define compression chambers 15. A motor 22, which may be a variable speed motor, causes a drive shaft 24 to rotate. A non-rotating coupling, which may be an Oldham coupling 25 causes the orbiting scroll member 26 to orbit relative to the wraps 29 of the non-orbiting scroll 28. As this occurs, a refrigerant entrapped in the compression chambers 15 is compressed and driven towards a discharge port 18. Discharge port 18 communicates with a discharge chamber 19, such that refrigerant having been compressed is delivered into the compression chamber 19. The scroll compressor extends along a central longitudinal axis A1.

A suction tube 129 is connected to a source of refrigerant and may be connected within shell 32.

A temperature sensor 50 is illustrated being positioned on an outer surface of the upper shell 30 and generally aligned to be over the port 18. The temperature sensor 50 is sensitive to the temperature within the chamber 19. Should the temperature reach an unduly high level, this will be sensed by a control 44, which can operate to shut down motor 22.

Figure 2A:
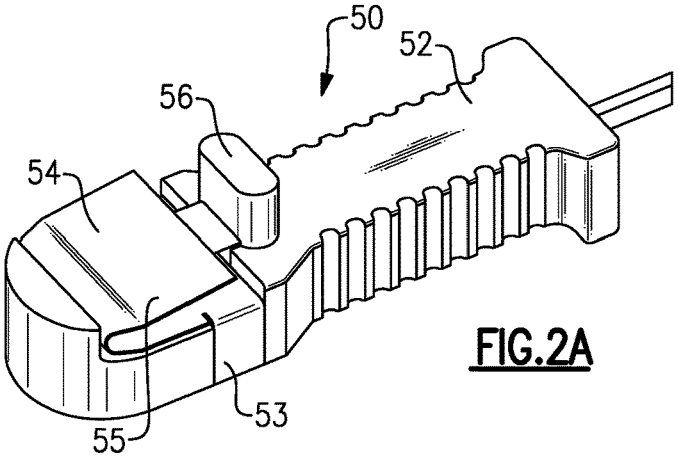
FIG. 2A shows a sensor.
Figure 2B:
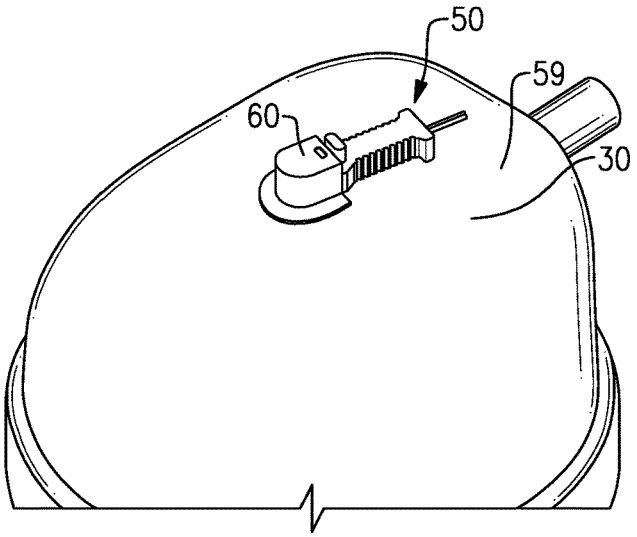
FIG. 2B shows the sensor mounted on a housing for the scroll compressor.

FIG. 2A shows a detail of the sensor 50. An overmolded plastic body 52 protects the internal electronics. A spring 54 has an upper bias member 55 and side legs 53 connected onto the overmolded plastic body 52. A tab 56 provides a stop to ensure that the sensor 50 is not inserted into a housing 60 (See FIG. 3) in a vertically incorrect orientation. FIG. 2B shows the sensor 50 mounted within a housing 60 on the upper surface 59 of the upper shell 30.

Figure 3:
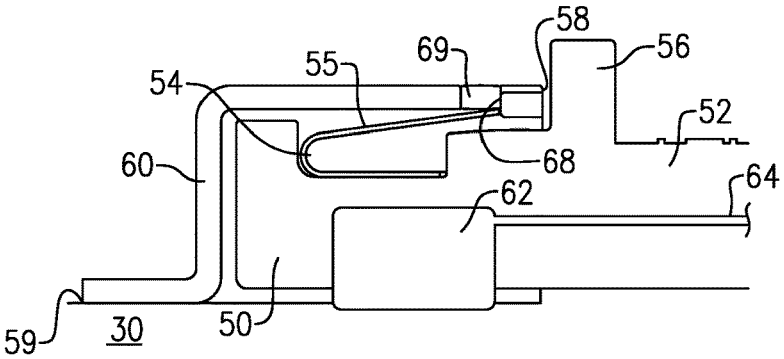
FIG. 3 is a cross-sectional view through the sensor and the sensor housing.

As shown in FIG. 3, the housing 60 is welded to an upper surface 59 of the upper shell housing 30. Electronics 62 are mounted within the overmolded housing 52 and communicate with a wire 64, which, in turn, communicates with the control 44.

The spring extends upwardly to contact a wall 68 of an opening 69 in the housing 60. The stop 56 abut a surface 58 of the housing 60 to provide a stop surface.

Figure 4:
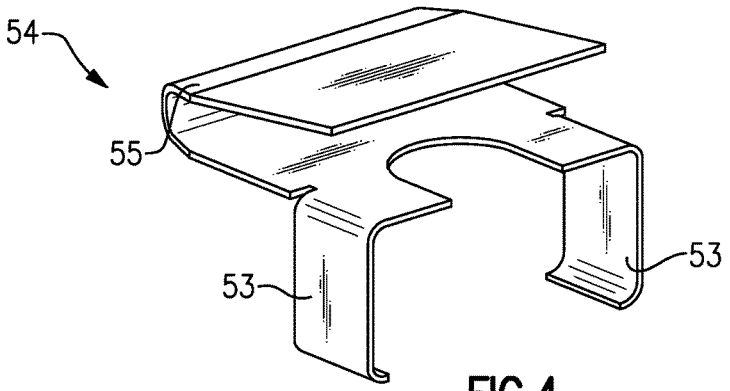
FIG. 4 shows a spring.
Figure 5:
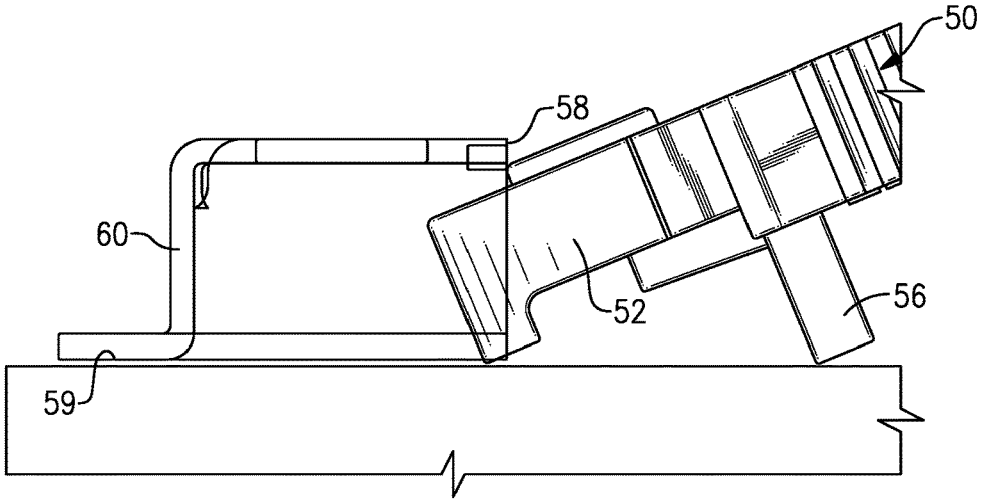
FIG. 5 shows the insertion of the sensor into the sensor housing.

FIG. 4 shows details of the spring 54 including the bias member 55 and the legs 53. As can be appreciated, the legs 53 fit into slots, one on the side of the overmolded body 52. (See FIG. 2A and FIG. 5). Alternatively, the spring could be attached to body 52 without legs, such as by being hot-staked. FIG. 5 shows the sensor 50 being inserted into the housing 60. As can be appreciated from FIG. 3, the bias member 55 provides a bias force holding the electronics 62 against the surface 59. However, a technician can manipulate, through the opening 69, to move the bias member 55 inwardly to allow removal of the sensor 50. Further, the housing portion 58 will bend the bias portion 59 inwardly to allow insertion such as shown generally in FIG. 5.

Figure 6:
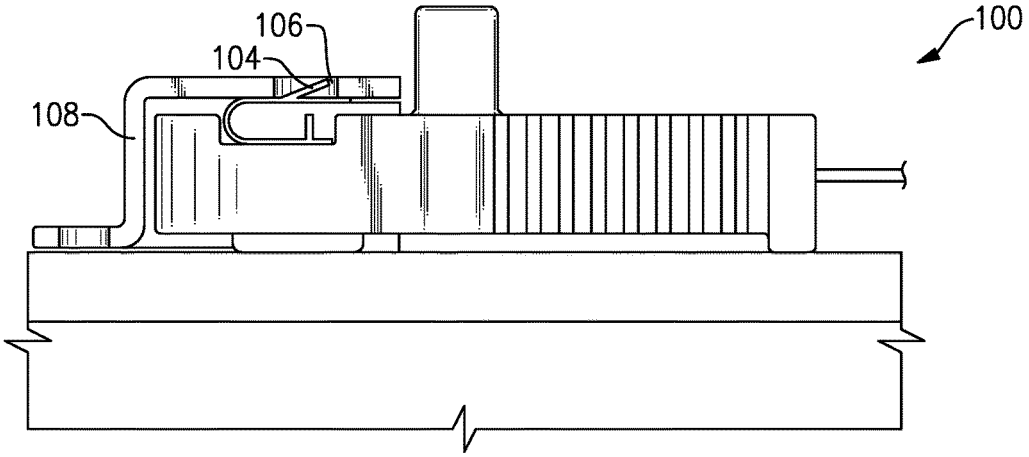
FIG. 6 shows another embodiment.

FIG. 6 shows another embodiment 100 wherein the spring member 108 has a bias member 104 extending upwardly further into the opening 106.

The sensor electronics 62 be a thermistor. The scroll compressor housing and the spring may be metallic.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A scroll compressor comprising:

a housing including a cylindrical lower portion and an upper cover, said upper cover having an outer surface;

a scroll compressor pump unit including a first scroll member having a base and a generally spiral wrap extending from its base, and a second scroll member having a base and a generally spiral wrap extending from its base, said wraps of said first and second scroll members interfitting to define a compression chamber, and said first scroll member having a discharge port;

an electric motor for driving a drive shaft to rotate and, in turn, cause said second scroll member to orbit relative to said first said scroll member to decrease a volume of said compression chamber such that a refrigerant is entrapped and is driven to communicate with said discharge port;

a discharge chamber defined inwardly of said upper cover and communicating with said discharge port; and a temperature sensor connected to said outer surface at a location associated with said discharge chamber, said temperature sensor including a spring member, said spring member snapping into a sensor housing connected to said outer surface, wherein said sensor housing has a front opening for receipt of said sensor such that said sensor can be inserted and removed from said front opening;

wherein said temperature sensor is enclosed in overmolded plastic and said overmolded plastic has a tab extending outwardly in a direction away from said outer surface to be beyond a portion of said sensor housing defining said front opening such that said temperature sensor cannot be inserted in a reversed manner.

2. The scroll compressor as set forth in claim 1, wherein said sensor housing and said spring member are metallic.

3. The scroll compressor as set forth in claim 1, wherein said sensor includes an electronic component in contact with said outer surface.

4. The scroll compressor as set forth in claim 3, wherein said electronic component is a thermistor.

5. The scroll compressor as set forth in claim 3, wherein said electronic component communicates with a control circuit to allow shutdown of said electric motor if a temperature exceeds a predetermined amount.

6. The scroll compressor as set forth in claim 5, wherein said electric motor is a variable speed motor.

7. The scroll compressor as set forth in claim 3, wherein said spring member includes a bias portion which is biased inwardly to provide a bias force holding said electronic component against said outer surface.

8. A scroll compressor comprising:

a housing including a cylindrical lower portion and an upper cover, said upper cover having an outer surface;

a scroll compressor pump unit including a first scroll member having a base and a generally spiral wrap extending from its base, and a second scroll member having a base and a generally spiral wrap extending from its base, said wraps of said first and second scroll members interfitting to define a compression chamber, and said first scroll member having a discharge port;

an electric motor for driving a drive shaft to rotate and, in turn, cause said second scroll member to orbit relative to said first said scroll member to decrease a volume of said compression chamber such that a refrigerant is entrapped and is driven to communicate with said discharge port;

a discharge chamber defined inwardly of said upper cover and communicating with said discharge port; and a temperature sensor connected to said outer surface at a location associated with said discharge chamber, said temperature sensor including a spring member, said spring member snapping into a sensor housing connected to said outer surface, wherein said sensor housing has a front opening for receipt of said sensor such that said sensor can be inserted and removed from said front opening;

wherein said temperature sensor is enclosed in overmolded plastic and said overmolded plastic has a tab extending outwardly in a direction away from said outer surface to be beyond a portion of said sensor housing defining said front opening such that said temperature sensor cannot be inserted in a reversed manner;

wherein said sensor includes an electronic component in contact with said outer surface, wherein said spring member includes a bias portion which is biased inwardly to provide a bias force holding said electronic component against said outer surface; and wherein an additional, second opening is provided in said sensor housing to allow movement of said bias portion inwardly away from said sensor housing such that said sensor can be removed from said sensor housing.

9. The scroll compressor as set forth in claim 1, wherein said spring member includes a pair of opposed legs which sit in slots in said overmolded plastic.

10. The scroll compressor as set forth in claim 1, wherein said sensor housing is welded to said outer surface.

11. The scroll compressor as set forth in claim 1, wherein said sensor can be inserted and removed from said front opening in a direction generally perpendicular to a central longitudinal axis of the scroll compressor pump unit.

12. The scroll compressor as set forth in claim 1, wherein the tab contacts an outer end of the sensor housing when the temperature sensor is inserted into the sensor housing.

13. The scroll compressor of claim 1, wherein the tab is separate and spaced apart from the spring member.

* * * * *